US010170063B2

(12) United States Patent
Zhang

(10) Patent No.: US 10,170,063 B2
(45) Date of Patent: Jan. 1, 2019

(54) MURA COMPENSATION METHOD FOR DISPLAY PANEL AND DISPLAY PANEL

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/552,292

(22) PCT Filed: May 24, 2017

(86) PCT No.: PCT/CN2017/085760
§ 371 (c)(1),
(2) Date: Aug. 20, 2017

(65) Prior Publication Data

US 2018/0322834 A1 Nov. 8, 2018

(30) Foreign Application Priority Data

May 3, 2017 (CN) ..... 2017 1 0316827

(51) Int. Cl.
*G09G 3/36* (2006.01)
*G09G 3/20* (2006.01)

(52) U.S. Cl.
CPC ..... *G09G 3/3607* (2013.01); *G09G 3/2007* (2013.01); *G09G 3/3611* (2013.01); *G09G 2320/0233* (2013.01)

(58) Field of Classification Search
USPC ..... 345/89, 690, 691, 214, 87, 698
See application file for complete search history.

(56) References Cited

U.S. PATENT DOCUMENTS 9,959,804 B1 * 5/2018 Kuang ..... G09G 3/2092 345/690
2009/0167751 A1 * 7/2009 Kerofsky ..... G09G 3/3406 345/214

(Continued)

FOREIGN PATENT DOCUMENTS

CN 102280097 A 12/2011
WO 2016149877 A1 9/2016

*Primary Examiner* — Thuy Pardo
(74) *Attorney, Agent, or Firm* — Andrew C. Cheng

(57) ABSTRACT

A mura compensation method for display panel is disclosed, including: compressing on an array basis of n*m pixels, storing a default mura compensation value corresponding to a first pixel in each area; based on the default mura compensation value, performing linear interpolation calculation to obtain mura compensation values for pixels in the same area other than the first pixel, and performing mura compensation to the display panel; after performing mura compensation to the display panel, obtaining information of an X-th area still having mura phenomenon, the X-th area being an area formed by compression on an array basis of n*m pixels of the display panel; obtaining a final grayscale compensation curve equation; based on the default mura compensation value and the final grayscale compensation curve equation, calculating supplementary mura compensation values for pixels in the X-th area other than the first pixel; re-performing the mura compensation to the X-th area.

10 Claims, 5 Drawing Sheets

(56) References Cited

U.S. PATENT DOCUMENTS

| | | | | |
|---|---|---|---|---|
| 2009/0267876 | A1* | 10/2009 | Kerofsky | G09G 3/2007 345/87 |
| 2014/0341467 | A1 | 11/2014 | Seo | |
| 2015/0187289 | A1* | 7/2015 | Kim | G01M 11/064 345/89 |
| 2016/0019849 | A1* | 1/2016 | Chang | G09G 3/3607 345/690 |
| 2016/0189347 | A1* | 6/2016 | Hu | G06T 5/00 345/589 |
| 2016/0267838 | A1* | 9/2016 | Zhang | G09G 3/2003 345/690 |
| 2017/0206825 | A1* | 7/2017 | Cha | G09G 3/2092 345/691 |
| 2018/0047368 | A1* | 2/2018 | Luo | G09G 3/20 345/89 |
| 2018/0108288 | A1* | 4/2018 | Kuang | G09G 3/2092 345/89 |
| 2018/0182305 | A1* | 6/2018 | Zhang | G09G 3/3406 345/89 |
| 2018/0190213 | A1* | 7/2018 | Zhang | G09G 3/36 345/89 |

* cited by examiner

MURA COMPENSATION METHOD FOR DISPLAY PANEL AND DISPLAY PANEL

CROSS REFERENCE TO RELATED APPLICATIONS

This application claims the priority of Chinese Patent Application No. CN201710316827.7, entitled "Mura Compensation Method for Display Panel and Display Panel", filed on May 3, 2017, the disclosure of which is incorporated herein by reference in its entirety.

BACKGROUND OF THE INVENTION

1. Field of the Invention

The present invention relates to the field of display, and in particular to the field of mura phenomenon compensation method for display panel and display panel.

2. The Related Arts

Because of various defects in the manufacturing process of liquid crystal display (LCD), the manufactured LCD panel may have non-uniform luminance and display various mura phenomena (the mura phenomenon refers to the marks caused by non-uniform luminance of the display panel.)

To improve the luminance uniformity of the display panel, some mura compensation methods are developed. For example, an external high-resolution camera is used to take a few grayscale frames (pure white screen with different luminance) mura forms. By comparing the brightness of the center position of the display panel, the brightness difference between the surrounding area and the center position is computed, and then compensates the grayscale value of the mura location (by reducing the grayscale value for area brighter than the center position to reduce brightness, and increasing the grayscale value for area darker than the center to increase brightness) to make the display panel as a whole to achieve a more consistent brightness.

In general, the reverse compensation data is stored in flash memory. Also, to reduce cost, the flash memory does not store the grayscale compensation data for each pixel. The known approach is to compress an area of n*n pixels (for example, 8*8 pixels), and each area stores the grayscale compensation data for one of the pixels in the flash. The other pixels in the area use grayscale compensation data calculated by linear interpolation.

Take Ultra High Definition (UHD) display panel (3840*2160 pixels—a display panel with 3840 columns and 2160 rows of pixels) as an example. Refer to FIG. 1, by compressing an 8*8 pixel area, the compression results in 480*270 areas (the dash square in the figure indicates an area). The data memory stores the mura compensation data corresponding to pixels at the intersections of the $1^{st}$, $9^{th}$, $17^{th}$, . . . , $2145^{th}$, $2153^{rd}$ columns and the $1^{st}$, $9^{th}$, $17^{th}$, . . . , $3825^{th}$, $3833^{rd}$ rows (indicated by the circled pixels). The total of 480*270 mura compensation data is stored. Moreover, to calculate the mura compensation data corresponding to the pixels of the $3834^{th}$-$3840^{th}$ columns and pixels of the $2154^{th}$-$2160^{th}$ rows, the stored mura compensation data corresponding to the $3825^{th}$ column and $3833^{rd}$ column are used to calculate to obtain the mura compensation data corresponding to the pixel of the $3841^{st}$ column (virtual pixel with circle in the figure) with 270 mura compensation data. By using stored mura compensation data corresponding to the $2145^{th}$ row and $2153^{rd}$ row, the mura compensation data corresponding to the pixel of the $2161^{st}$ row (virtual pixel with circle in the figure) is calculated to obtain 480 mura compensation data. Accordingly, the data memory needs to store 481*271 mura compensation data, and the mura compensation data for the remaining pixels are calculated by a timing controller (Tcon IC) based on linear interpolation with the existing 481*271 mura compensation data.

For the specific calculation for the remaining pixels, also refer to FIG. 1. Take area formed by the pixels of the $1^{st}$-$8^{th}$ row $1^{st}$-$8^{th}$ column (8*8 pixels) as example. In the area, assume that the pixel at the intersection of the $1^{st}$ column and $1^{st}$ row (left upper corner pixel) corresponds to a mura compensation value A', the pixel at the intersection of the $9^{th}$ column and $1^{st}$ row corresponds to a mura compensation value B', the pixel at the intersection of the $1^{st}$ column and $9^{th}$ row corresponds to a mura compensation value C', the pixel at the intersection of the $9^{th}$ column and $9^{th}$ row corresponds to a mura compensation value D', the pixel e' corresponds to a mura compensation value E', the pixel f' corresponds to a mura compensation value F', the pixel g' corresponds to a mura compensation value G'; wherein, the mura compensation value A', B', C', D' are known values. After linear interpolation, the E', F' and G' are calculated as follows:

$$E'=[(8-Y')*A'+Y'*C']/8;$$

$$F'=[(8-Y')*B'+Y'*D']/8;$$

$$G'=[(8-X')*E'+X'*F']/8.$$

Wherein the X' and Y' are the number of pixels spaced apart between the corresponding pixel and the pixel at the intersection of $1^{st}$ column and $1^{st}$ row in the direction of row and column respectively.

However, when the mura change in an area is drastic, and the grayscale compensation data calculated by the above linear interpolation is used for compensation, as shown in FIG. 2, the area with drastic change in mura condition still shows apparent mura phenomenon (see FIG. 2 for the left and right ends of the display effect when uncompensated). The non-uniform luminance can still show after compensation; therefore, the known linear interpolation method is no longer sufficient to address the mura issue.

SUMMARY OF THE INVENTION

The primary object of the present invention is to provide a mura compensation method for display panel and display panel, to alleviate the non-uniform luminance problem of the display panel.

To solve the above problem, the present invention provides a mura compensation method for display panel, comprising:

compressing on an array basis of n*m pixels, storing a default mura compensation value corresponding to a first pixel in each area, wherein, n and m being integers greater than or equal to 2;

based on the default mura compensation value, performing linear interpolation calculation to obtain mura compensation values for pixels in the same area other than the first pixel, and performing mura compensation to the display panel;

after performing mura compensation to the display panel, obtaining information of an X-th area still having mura phenomenon, wherein the X-th area belonging to an area formed by compression on an array basis of n*m pixels of the display panel;

obtaining a final grayscale compensation curve equation;

based on the default mura compensation value and the final grayscale compensation curve equation, calculating to obtain supplementary mura compensation values for pixels in the X-th area other than the first pixel;

based on the default mura compensation value and the supplementary mura compensation values, re-performing the mura compensation to the X-th area.

According to an embodiment of the present invention, the step of obtaining a final grayscale compensation curve equation comprises:

storing an initial grayscale compensation curve equation;

based on the stored default mura compensation values of the X-th area and adjacent areas, calculating to obtain the final grayscale compensation curve equation.

According to an embodiment of the present invention, the initial grayscale compensation curve equation is:

$$y=ax^n+bx^{n-1}+\ldots+cx+d;$$

wherein y is a mura compensation value, x is the number of pixels spaced apart between the pixel with mura compensation value to be calculated in the X-th area and a reference pixel in the column or row direction; when the pixel with mura compensation value to be calculated and the first pixel are in the same row or same column, the reference pixel is the first pixel; when the pixel with mura compensation value to be calculated and the first pixel are not in the same row nor same column, the reference pixel and the pixel with mura compensation value to be calculated are in the same row or same column and the reference pixel and the first pixel in the X-th area correspond to the same column or same row; n is an integer greater than or equal to 2, a is a non-zero rational number, b, . . . , c, d are rational number.

According to an embodiment of the present invention, the initial grayscale compensation curve equation is:

$$y=ax^2+cx+d.$$

According to an embodiment of the present invention, the initial grayscale compensation curve equation is stored in a data memory or a timing controller.

According to an embodiment of the present invention, the method comprises a step before the step of obtaining a final grayscale compensation curve equation:

storing the final grayscale compensation curve equation.

According to an embodiment of the present invention, n=m.

The present invention also provides a display panel, comprising:

a first storage unit, for compressing on an array basis of n*m pixels, storing a default mura compensation value corresponding to a first pixel in each area, wherein, n and m being integers greater than or equal to 2;

a calculation compensation unit, for, based on the default mura compensation value, performing linear interpolation calculation to obtain mura compensation values for pixels in the same area other than the first pixel, and performing mura compensation to the display panel;

a first obtaining unit, for, after performing mura compensation to the display panel, obtaining information of an X-th area still having mura phenomenon, wherein the X-th area belonging to an area formed by compression on an array basis of n*m pixels of the display panel;

a second obtaining unit, for, obtaining a final grayscale compensation curve equation;

a calculation unit, for, based on the default mura compensation value and the final grayscale compensation curve equation, calculating to obtain supplementary mura compensation values for pixels in the X-th area other than the first pixel; and a compensation unit, for, based on the default mura compensation value and the supplementary mura compensation values, re-performing the mura compensation to the X-th area.

According to an embodiment of the present invention, the second obtaining unit comprises:

a storage sub-unit, for storing an initial grayscale compensation curve equation; and a processing sub-unit, for, based on the stored default mura compensation values of the X-th area and adjacent areas, calculating to obtain the final grayscale compensation curve equation.

According to an embodiment of the present invention, the processing sub-unit is inside a timing controller.

The embodiments of the present invention provides the following advantages:

When the present invention, after performing mura compensation to the display panel, obtains information of an X-th area still having mura phenomenon, the display panel does not re-perform regular mura compensation to the X-th area, but uses the final grayscale compensation curve equation to obtain the supplementary mura compensation values for pixels in the X-th area other than the first pixel based on the default mura compensation value and the final grayscale compensation curve equation; and for, based on the default mura compensation value and the supplementary mura compensation values, re-performs the mura compensation to the X-th area. As such, the mura problem in the X-th area can be improved, leading to display effect improvement for display panel with drastic mura changes.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

The terms "comprising" and "having" and any variations thereof appearing in the specification, claims, and drawings of the present application are intended to cover non-exclusive inclusion. For example, a process, method, system, product, or device that includes a series of steps or units is not limited to the listed steps or units, but optionally also includes steps or units not listed, or alternatively, other steps or units inherent to these processes, methods, products or equipment. In addition, the terms "first", "second" and "third" are used to distinguish different objects, and are not intended to describe a particular order.

Figure 1:
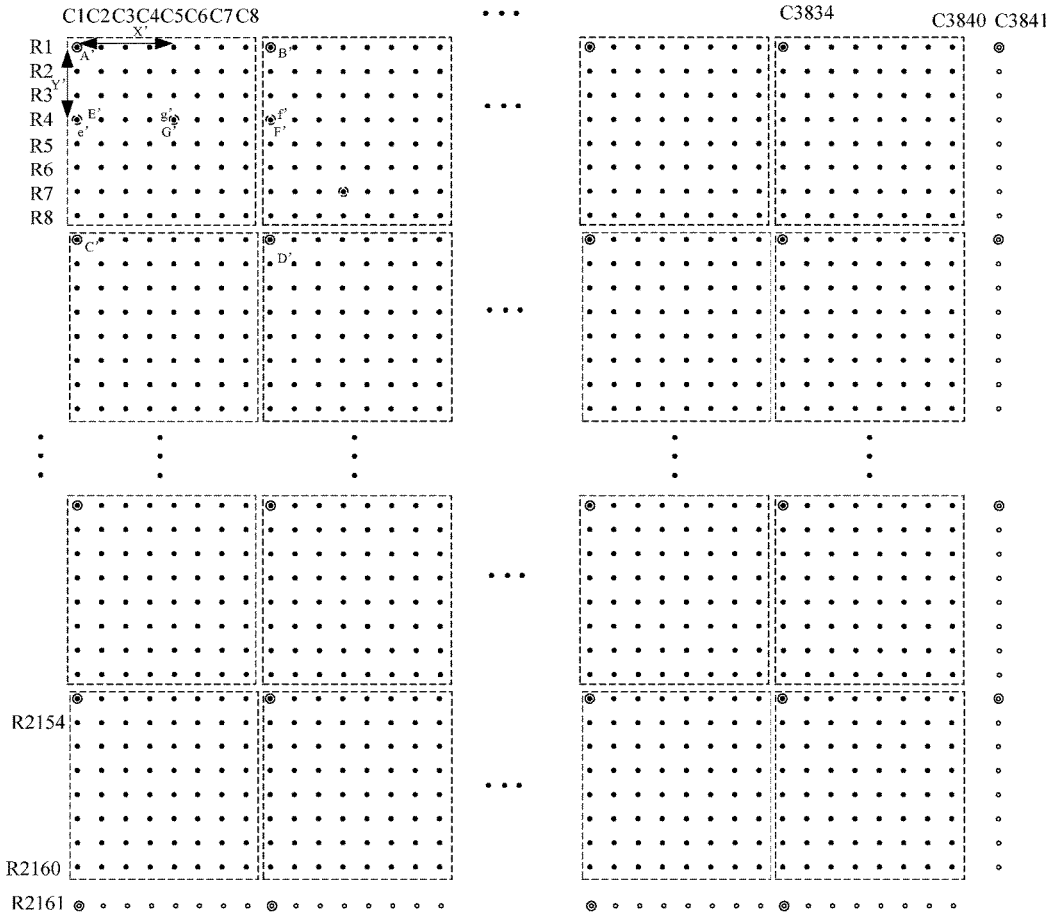
FIG. 1 is a schematic view showing the pixel arrangement (display panel storing mura compensation values for pixels with circles in the figure) in the known display panel.
Figure 2:
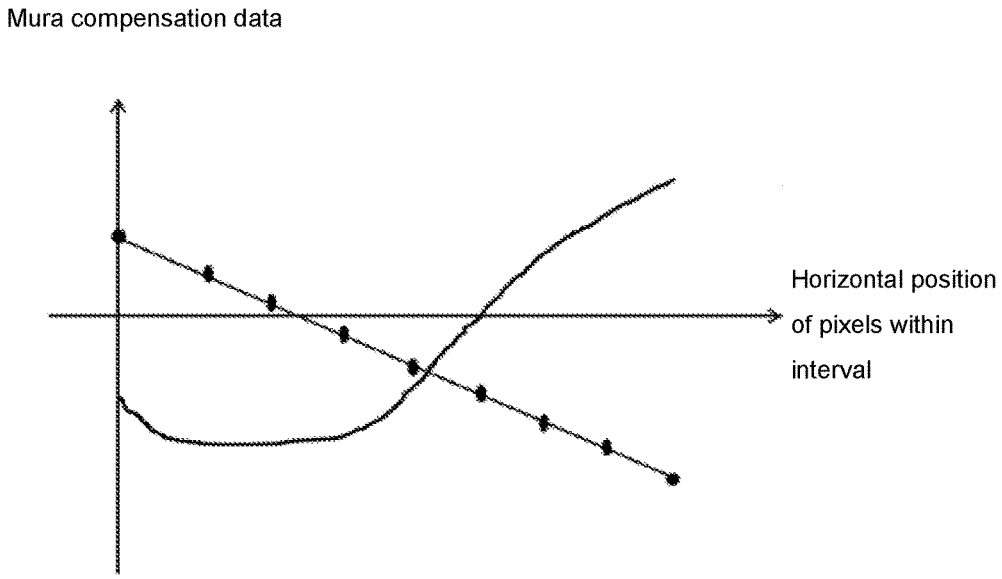
FIG. 2 is a schematic view showing the display effect (curve) when un-compensated and the linear interpolation calculation compensation line (slant line) for an area in a known display panel.
Figure 3:
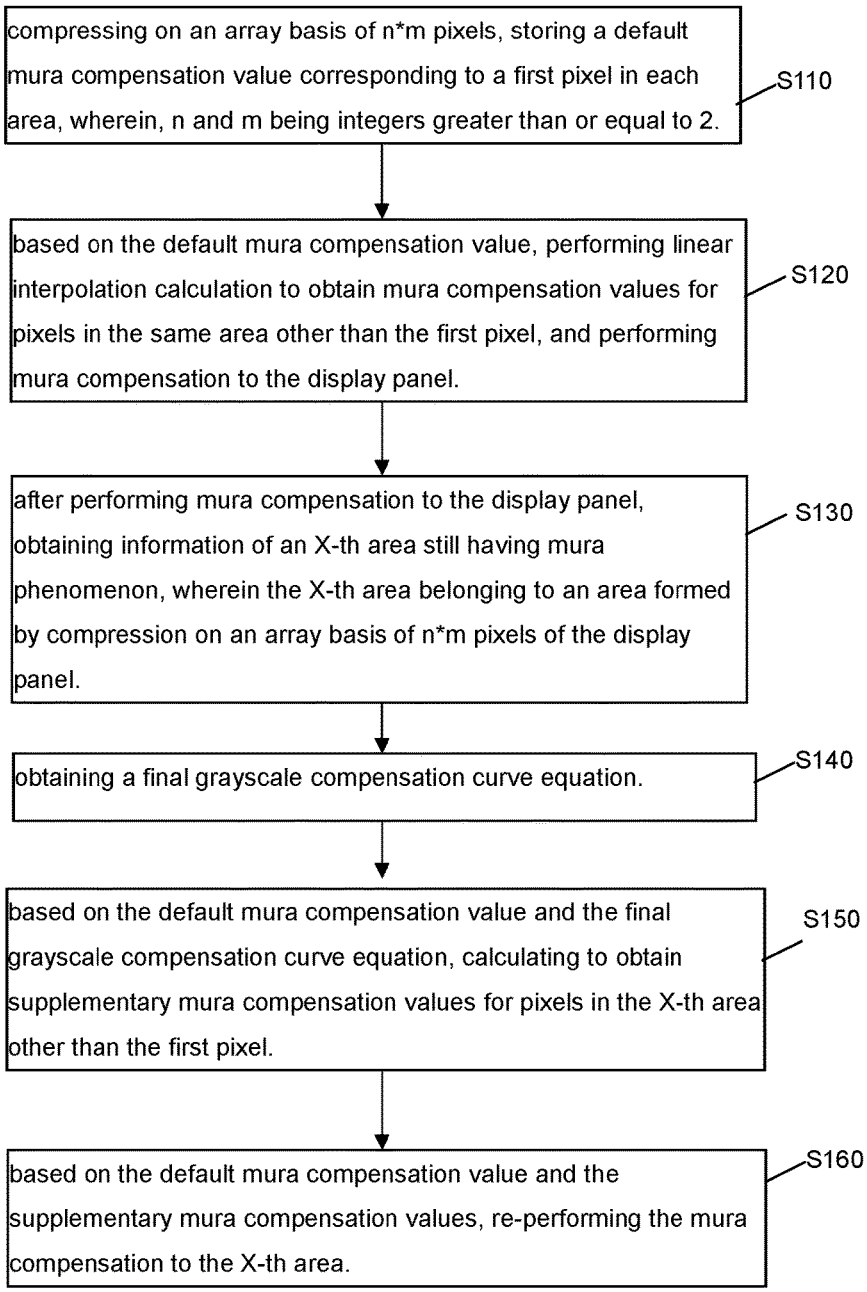
FIG. 3 is a flowchart showing the mura compensation method for display panel according to an embodiment of the present invention.
Figure 4:
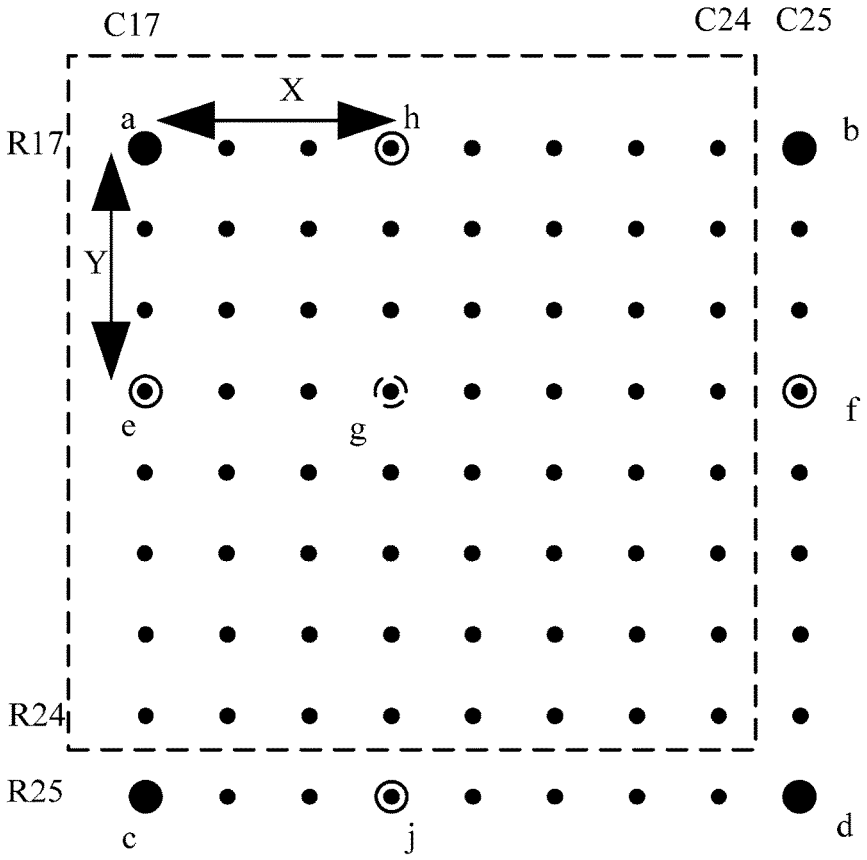
FIG. 4 is a schematic view showing the pixel arrangement of the X-th area.
Figure 5:
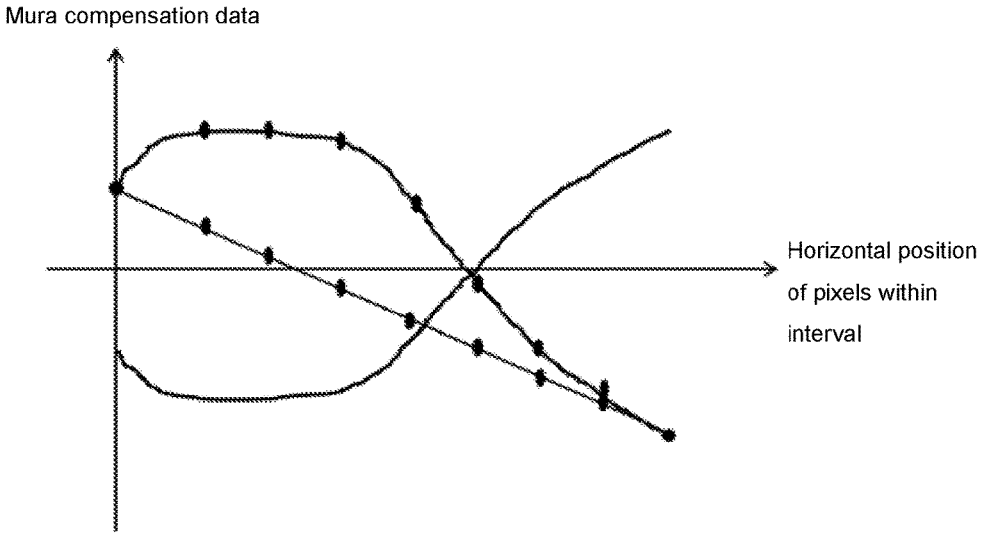
FIG. 5 is a schematic view showing the comparison among the display effect (downward curve) when un-compensated and the linear interpolation calculation compensation line (slant line) and a compensation curve (upward curve) for the X-th area in a display panel of the present invention.
Figure 6:
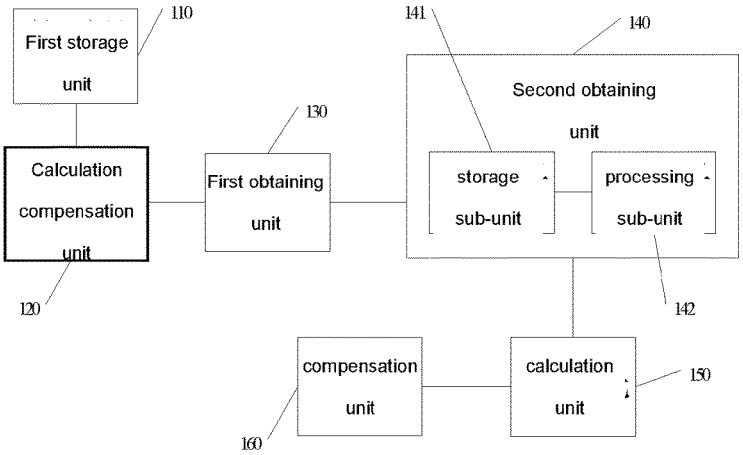
FIG. 6 is a schematic view showing the structure of a display panel according to the present invention.

The present invention provides a mura compensation method for display panel, wherein the display panel can be a liquid crystal display (LCD) panel or other types of display panel. In the following description, the Ultra High Definition (UHD) panel (with 3840*2160 pixels) is used as an example for the display panel. Apparently, in other embodiments, other resolutions can be used, such as, 1920*1080, and so on. Referring to FIGS. 3-5, the method comprising the following steps:

S110: compressing on an array basis of n*m pixels, storing a default mura compensation value corresponding to a first pixel in each area, wherein, n and m being integers greater than or equal to 2.

In the present invention, n=m, and n=m=8. Apparently, in other embodiments, n and m can be different, and are both integers greater than or equal to 2.

In the present embodiment, the display panel is compressed on a basis of an 8*8 pixel area, and the compression results in 480*270 areas (3840/8=480, 2160/8=270). The mura compensation value corresponding a first pixel of each area is stored, for example, the mura compensation value corresponding the left upper corner pixel in each area, and the first pixel is the left upper corner pixel of the area (as in the present embodiment). Alternatively, the mura compensation value corresponding the center pixel in each area, and the first pixel is the center pixel of the area. Any pixel can be selected as the first pixel of the area, and the corresponding mura compensation value of the selected pixel is stored. Accordingly, the data memory needs to store 481*271 mura compensation values instead of mura compensation value for each pixel in the display panel As a result, a large amount of memory space is save and the cost is reduced.

S120: based on the default mura compensation value, performing linear interpolation calculation to obtain mura compensation values for pixels in the same area other than the first pixel, and performing mura compensation to the display panel.

In the present embodiment, based on the stored 481*271 mura compensation values and linear interpolation calculation, the mura compensation values for pixels in the same area other than the first pixel are obtained. Specifically calculation may be referred to the background section. As a result, the mura compensation values corresponding to all the pixels can be obtained and mura compensation to the display panel is performed.

S130: after performing mura compensation to the display panel, obtaining information of an X-th area still having mura phenomenon, wherein the X-th area belonging to an area formed by compression on an array basis of n*m pixels of the display panel.

In the present embodiment, the display panel forms 480*270 areas. When processed by an external mura repair system, the external repair system comprises a high definition camera and a computer. Specifically, the processing comprises: the display panel uses the linear interpolation to calculate the mura compensation values for the other pixels in each area, in other words, the mura compensation values for the other 63 pixels (8*8−1, other than the first pixel) in the area. After mura compensation, the display panel displays an image, and the high definition camera takes the picture and transmits the picture to the computer. After processed by the computer, the information is obtained that the X-th area of the display panel still shows mura phenomenon. The computer transmits the information that the X-th area of the display panel still shows mura phenomenon to the display panel, and the display panel obtains the information that the X-th area of the display panel still shows mura phenomenon. Apparently, the areas other than the X-th area can still apply linear interpolation to calculate the mura compensation values for the other pixel excep the first pixel. Wherein, the X-th area X-th area belongs to an area formed by compression on an array basis of 8*8 pixels of the display panel. Here, a total of 480*270 areas are formed and the X-th area is one of the 480*270 areas. For example, the area coordination for the X-th area is (3,3) and the coordination system is formed by 480 areas in the row direction and 270 areas in the column direction. In other words, the (3, 3) area is the area at the intersection of the third column and the third row. In addition, when the display panel has a plurality of areas not applicable to mura compensation values, the X-th area is not restricted to a single area, but also can be a plurality of areas.

S140: obtaining a final grayscale compensation curve equation.

In the present embodiment, the display panel obtains a final grayscale compensation curve equation, instead of linear equation calculated by the linear interpolation currently used. The final grayscale compensation curve equation is a non-linear compensation equation, and the non-linear compensation equation, for example, can be a quadratic equation, a cubic equation, a quartic equation, a quintac equation, . . . , a k-th order equation, where k is an integer greater than or equal to 2. Also, in the present embodiment, the grayscale compensation curve equations for different column or row in the same area have the same k-th order, but may be with the same or different coefficients.

In the present embodiment, the specific steps of obtaining a final grayscale compensation curve equation comprise:

S141: storing an initial grayscale compensation curve equation.

In the present embodiment, the display panel stores the initial grayscale compensation curve equation, and the initial grayscale compensation curve equation can be specifically stored in a data memory or a timing controller (Tcon IC). The initial grayscale curve equation is:

$$y=ax^n+bx^{n-1}+\ldots+cx+d;$$

wherein y is a mura compensation value, n is an integer greater than or equal to 2, a is a non-zero rational number, b, c, d are rational number; x is the number of pixels spaced apart between the pixel with mura compensation value to be calculated in the X-th area and a reference pixel in the column or row direction; when the pixel with mura compensation value to be calculated and the first pixel are in the same row or same column, the reference pixel is the first pixel; when the pixel with mura compensation value to be calculated and the first pixel are not in the same row nor same column, the reference pixel and the pixel with mura compensation value to be calculated are in the same row or same column and the reference pixel and the first pixel in the X-th area correspond to the same column or same row. For example, when the pixel with mura compensation value to be calculated and the first pixel are in the same row or column, (for example, the h pixel or e pixel in FIG. 4), the first pixel (pixel a) is the reference pixel; when the mura compensation value to be calculated (for example, pixel g in FIG. 4) and the first pixel (pixel) a is not in the same column or row, the reference pixel is in the same row as the first pixel, and the reference pixel is in the same column as the pixel with mura compensation value to be calculated (pixel h in FIG. 4); alternatively, the reference pixel is in the same column as the first pixel, and the reference pixel is in the same row as the pixel with mura compensation value to be calculated (pixel e in FIG. 4). Refer to FIG. 4, the number X of pixel columns spaced apart from pixel h or the number Y of pixel columns spaced apart from pixel e for pixel g are both 3.

For example, the initial grayscale compensation curve equation is $y=ax^2+cx+d$, $y=ax^3+bx^2+cx+d$, $y=ax^4+bx^3+\ldots+cx+d$, $y=ax^5+bx^4+\ldots+cx+d$, $y=ax^6+bx^5+\ldots+cx+d$, and so on. In the present embodiment, the initial grayscale compensation curve equation is $y=ax^2+cx+d$, and the initial grayscale compensation curve equation is the same in the same area.

S142: based on the stored default mura compensation values of the X-th area and adjacent areas, calculating to obtain the final grayscale compensation curve equation.

In the present embodiment, because the display panel stores the initial grayscale compensation curve equation, and the coefficients in the equation are not calculated, i.e., the coefficients a, b, . . . , c, d are not calculated. The final grayscale compensation curve equation is calculated directly or indirectly based on the stored default mura compensation values of the X-th area and adjacent areas. For example, the area coordination of the X-th area is (3,3), and adjacent areas have the coordinates of (2, 3), (4, 3), (3, 2), (3, 4). In addition, the adjacent areas (2, 2), (2, 4), (4, 2), (4, 4) can also be included. By substituting the default mura compensation values of these adjacent areas into the initial grayscale compensation curve equation, the present invention can directly calculate the coefficients of the initial grayscale compensation curve equation of the same row or same column with the first pixel, so as to obtain a first final grayscale compensation curve equation for the pixels of the same row or column with the first pixel. Based on the first grayscale compensation curve equation, the present invention calculates the supplementary mura compensation value of the other pixels of the same row or same column with the first pixel. When the pixel with mura compensation value to be calculated is not of the same row or same column as the first pixel of the same area, the final grayscale compensation curve equation corresponding to the other pixels can be calculated indirectly based on stored mura compensation values for the X-th area and adjacent areas. Specifically, refer to FIG. 4. To obtain the mura compensation value corresponding to pixel g, a second final grayscale compensation curve equation for the column or the row of pixel g must be obtained first. The specific way to obtain the second final grayscale compensation curve equation is as follows: the supplementary mura compensation value for the other pixels of the same row or same column of the first pixel can be obtained based on the first final grayscale compensation curve equation, i.e., the supplementary mura compensation value for pixel h and pixel c. The linear interpolation can be used to calculate the mura compensation values for pixels in adjacent areas to the X-th area at the similar position of pixel h (such as, pixel j) and pixel e (such as, pixel f), and substituted into the initial grayscale compensation curve equation to obtain the coefficients of the initial grayscale compensation curve equation for the column or the row of pixel g so as to obtain indirectly the second final grayscale compensation curve equation, and furthermore, the supplementary mura compensation value corresponding to pixel g. in the present embodiment, the coefficients of the final grayscale compensation curve equation are different for pixels of different row or different column in the same area. Apparently, in other embodiments, the coefficients for the final grayscale compensation curve equation for the pixels in the same area can be the same.

Moreover, in other embodiments of the present invention, the step of storing the initial grayscale compensation curve equation and the step of obtaining the final grayscale compensation curve equation can be skipped. The display panel can directly store the final grayscale compensation curve equation, i.e., the coefficients of the final grayscale compensation curve equation are known, and then obtaining the final grayscale compensation curve equation.

S150: based on the default mura compensation value and the final grayscale compensation curve equation, calculating to obtain supplementary mura compensation values for pixels in the X-th area other than the first pixel.

In the present embodiment, after obtaining the final grayscale compensation curve equation, substituting the number of pixel columns or the number of pixel rows of the pixel with mura compensation value to be calculated spaced apart from the reference pixel and the supplementary mura compensation values for pixels in the X-th area other than the first pixel can be calculated. For example, the supplementary mura compensation values for the other 63 pixels in the X-th area other than the first pixel can be calculated.

S160: based on the default mura compensation value and the supplementary mura compensation values, re-performing the mura compensation to the X-th area.

After obtaining the supplementary mura compensation values for the other 63 pixels in the X-th area other than the first pixel, in combination with the default mura compensation value corresponding to the first pixel of the X-th area, the mura compensation is performed to the X-th area, and the final compensation result is shown in FIG. 5. After mura compensation with the mura compensation values calculated by the non-linear compensation curve equation, the X-th area shows more uniform luminance and better display effect in comparison with the known technology.

In the present embodiment, when the display panel, after performing mura compensation to the display panel, obtains information of an X-th area still having mura phenomenon, the display panel does not re-perform regular mura compensation to the X-th area, but uses the final grayscale compensation curve equation to obtain the supplementary mura compensation values for pixels in the X-th area other than the first pixel based on the default mura compensation value and the final grayscale compensation curve equation; and for, based on the default mura compensation value and the supplementary mura compensation values, re-performs the mura compensation to the X-th area. As such, the mura problem in the X-th area can be improved, leading to display effect improvement for display panel with drastic mura changes.

Furthermore, the present invention also provides a display panel. Refer to FIG. 4. The display panel comprises:

a first storage unit 110, for compressing on an array basis of n*m pixels, for example, in the present embodiment, 8*8 storing pixels are used an area for compression so that a panel with 3840*2160 resolution forming 480*270 areas; storing a default mura compensation value corresponding to a first pixel in each area, in the present embodiment, the number of stored mura compensation values is 481*271. Wherein n and m are integers greater than or equal to 2. In the present embodiment, the first storage unit 110 can be a dta memory (flash). Apparently, in other embodiments, the first storage unit can also be a timing controller (Tcon IC).

a calculation compensation unit 120, for, based on the default mura compensation value, performing linear interpolation calculation to obtain mura compensation values for pixels in the same area other than the first pixel, and performing mura compensation to the display panel. in the present embodiment, based on the stored 481*271 mura compensation values and linear interpolation calculation, the calculation compensation unit 120 calculates the mura compensation values for pixels in the same area other than the first pixel. Specifically calculation may be referred to the background section. As a result, the mura compensation values corresponding to all the pixels can be obtained and mura compensation to the display panel is performed.

a first obtaining unit 130, for, after performing mura compensation to the display panel, obtaining information of an X-th area still having mura phenomenon, wherein the X-th area belonging to an area formed by compression on an array basis of n*m pixels of the display panel; after the display panel performs initial mura compensation, an external mura repair system can obtain the information that the X-th area of the display panel still shows mura phenomenon, and the information is transmitted the first obtaining unit 130 so that the first obtaining unit 130 obtains the information that the X-th area of the display panel still shows mura phenomenon.

a second obtaining unit 140, for, obtaining a final grayscale compensation curve equation. In the present embodiment, the second obtaining unit 140 obtains a final grayscale compensation curve equation, instead of the currently used linear interpolation equation. The final grayscale compensation curve equation can be a quadratic equation, a cubic equation, a quartic equation, a quintic equation, . . . , a k-th order equation, wherein k is an integer greater than or equal to 2.

a calculation unit 150, for, based on the default mura compensation value and the final grayscale compensation curve equation, calculating to obtain supplementary mura compensation values for pixels in the X-th area other than the first pixel. In the present embodiment, after obtaining the final grayscale compensation curve equation, the calculation unit 150 substituting the number of pixel columns or the number of pixel rows of the pixel with mura compensation value to be calculated spaced apart from the reference pixel and the supplementary mura compensation values for pixels in the X-th area other than the first pixel can be calculated. For example, the supplementary mura compensation values for the other 63 pixels in the X-th area other than the first pixel can be calculated.

a compensation unit 160, for, based on the default mura compensation value and the supplementary mura compensation values, re-performing the mura compensation to the X-th area. After obtaining the supplementary mura compensation values for the other 63 pixels in the X-th area other than the first pixel, in combination with the default mura compensation value corresponding to the first pixel of the X-th area, the mura compensation is performed to the X-th area, and the final compensation result is shown in FIG. 5. After mura compensation with the mura compensation values calculated by the non-linear compensation curve equation, the X-th area shows more uniform luminance and better display effect in comparison with the known technology.

In the present embodiment, the calculation compensation unit 120, the first obtaining unit 130, the second obtaining unit 140, the calculation unit 150 and the compensation unit 160 can be all integrated into a single device of the display panel, such as a timing controller (Tcon IC). Apparently, the calculation compensation unit 120, the first obtaining unit 130, the second obtaining unit 140, the calculation unit 150 and the compensation unit 160 can be individual component.

In the present embodiment, the second obtaining unit 140 specifically comprises:

a storage sub-unit 141, for storing an initial grayscale compensation curve equation. In the present embodiment, in the present embodiment, the storage sub-unit 141 stores the initial grayscale compensation curve equation, and the initial grayscale compensation curve equation can be specifically stored in a data memory or a timing controller (Tcon IC). The initial grayscale curve equation is:

$$y=ax^n+bx^{n-1}+\ldots+cx+d;$$

For example, the initial grayscale compensation curve equation is $y=ax^2+cx+d$, $y=ax^3+bx^2+cx+d$, $y=ax^4+bx^3+\ldots+cx+d$, $y=ax^5+bx^4+\ldots+cx+d$, $y=ax^6+bx^5+\ldots+cx+d$, and so on. In the present embodiment, the initial grayscale compensation curve equation is $y=ax^2+cx+d$.

a processing sub-unit 142, for, based on the stored default mura compensation values of the X-th area and adjacent areas, calculating to obtain the final grayscale compensation curve equation. In the present embodiment, because the storage sub-unit 141 stores the initial grayscale compensation curve equation, and the coefficients in the equation are not calculated, i.e., the coefficients a, b, . . . , c, d are not calculated. The final grayscale compensation curve equation is calculated directly or indirectly based on the stored default mura compensation values of the X-th area and adjacent areas.

In the present embodiment, the storage sub-unit 131 and the processing sub-unit 132 are integrated inside a timing controller.

It should be noted that each of the embodiments in this specification is described in a progressive manner, each of which is primarily described in connection with other embodiments with emphasis on the difference parts, and the same or similar parts may be seen from each other. For the device embodiment, since it is substantially similar to the method embodiment, the description is relatively simple and the relevant description may be described in part of the method embodiment.

With the above description, the present invention provides the following advantages:

When the present invention, after performing mura compensation to the display panel, obtains information of an X-th area still having mura phenomenon, the display panel does not re-perform regular mura compensation to the X-th area, but uses the final grayscale compensation curve equation to obtain the supplementary mura compensation values for pixels in the X-th area other than the first pixel based on the default mura compensation value and the final grayscale compensation curve equation; and for, based on the default mura compensation value and the supplementary mura compensation values, re-performs the mura compensation to the X-th area. As such, the mura problem in the X-th area can be improved, leading to display effect improvement for display panel with drastic mura changes.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A mura compensation method for display panel, comprising:

compressing on an array basis of n*m pixels, storing a default mura compensation value corresponding to a first pixel in each area, wherein, n and m being integers greater than or equal to 2;

based on the default mura compensation value, performing linear interpolation calculation to obtain mura compensation values for pixels in the same area other than the first pixel, and performing mura compensation to the display panel;

after performing mura compensation to the display panel, obtaining information of an X-th area still having mura phenomenon, wherein the X-th area belonging to an area formed by compression on an array basis of n*m pixels of the display panel;

obtaining a final grayscale compensation curve equation;

based on the default mura compensation value and the final grayscale compensation curve equation, calculating to obtain supplementary mura compensation values for pixels in the X-th area other than the first pixel;

based on the default mura compensation value and the supplementary mura compensation values, re-performing the mura compensation to the X-th area.

2. The mura compensation method for display panel as claimed in claim 1, wherein the step of obtaining a final grayscale compensation curve equation comprises:

storing an initial grayscale compensation curve equation;

based on the stored default mura compensation values of the X-th area and adjacent areas, calculating to obtain the final grayscale compensation curve equation.

3. The mura compensation method for display panel as claimed in claim 2, wherein the initial grayscale compensation curve equation is:

$$y=ax^n+bx^{n-1}+\ldots+cx+d;$$

wherein y is a mura compensation value, x is the number of pixels spaced apart between the pixel with mura compensation value to be calculated in the X-th area and a reference pixel in the column or row direction; when the pixel with mura compensation value to be calculated and the first pixel are in the same row or same column, the reference pixel is the first pixel; when the pixel with mura compensation value to be calculated and the first pixel are not in the same row nor same column, the reference pixel and the pixel with mura compensation value to be calculated are in the same row or same column and the reference pixel and the first pixel in the X-th area correspond to the same column or same row; n is an integer greater than or equal to 2, a is a non-zero rational number, b, . . . , c, d are rational number.

4. The mura compensation method for display panel as claimed in claim 3, wherein the initial grayscale compensation curve equation is:

$$y=ax^2+cx+d.$$

5. The mura compensation method for display panel as claimed in claim 2, wherein the initial grayscale compensation curve equation is stored in a data memory or a timing controller.

6. The mura compensation method for display panel as claimed in claim 1 wherein the method comprises a step before the step of obtaining a final grayscale compensation curve equation:

storing the final grayscale compensation curve equation.

7. The mura compensation method for display panel as claimed in claim 1, wherein n=m.

8. A display panel, comprising:

first storage unit, for compressing on an array basis of n*m pixels, storing a default mura compensation value corresponding to a first pixel in each area, wherein, n and m being integers greater than or equal to 2;

a calculation compensation unit, for, based on the default mura compensation value, performing linear interpolation calculation to obtain mura compensation values for pixels in the same area other than the first pixel, and performing mura compensation to the display panel;

a first obtaining unit, for, after performing mura compensation to the display panel, obtaining information of an X-th area still having mura phenomenon, wherein the X-th area belonging to an area formed by compression on an array basis of n*m pixels of the display panel;

a second obtaining unit, for, obtaining a final grayscale compensation curve equation;

a calculation unit, for, based on the default mura compensation value and the final grayscale compensation curve equation, calculating to obtain supplementary mura compensation values for pixels in the X-th area other than the first pixel; and a compensation unit, for, based on the default mura compensation value and the supplementary mura compensation values, re-performing the mura compensation to the X-th area.

9. The display panel as claimed in claim 8, wherein the second obtaining unit comprises:

a storage sub-unit, for storing an initial grayscale compensation curve equation; and a processing sub-unit, for, based on the stored default mura compensation values of the X-th area and adjacent areas, calculating to obtain the final grayscale compensation curve equation.

10. The display panel as claimed in claim 9, wherein the processing sub-unit is inside a timing controller.

* * * * *